US010329109B1

(12) United States Patent
Ferrara, Jr. et al.

(10) Patent No.: US 10,329,109 B1
(45) Date of Patent: Jun. 25, 2019

(54) VACUUM SHUTTLE WITH STITCH AND ROLL CAPABILITIES

(71) Applicant: Xerox Corporation, Norwalk, CT (US)

(72) Inventors: Joseph M. Ferrara, Jr., Webster, NY (US); Timothy D. Slattery, Elma, NY (US); Jacob R. McCarthy, Williamson, NY (US); James L. Pratt, Penfield, NY (US)

(73) Assignee: XEROX Corporation, Norwalk, CT (US)

( * ) Notice: Subject to any disclaimer, the term of this patent is extended or adjusted under 35 U.S.C. 154(b) by 0 days.

(21) Appl. No.: 15/944,112

(22) Filed: Apr. 3, 2018

(51) Int. Cl.
*B65H 9/00* (2006.01)
*B65H 9/10* (2006.01)

(52) U.S. Cl.
CPC ..... *B65H 9/105* (2013.01); *B65H 9/002* (2013.01); *B65H 2301/331* (2013.01); *B65H 2406/34* (2013.01); *B65H 2511/242* (2013.01)

(58) Field of Classification Search
CPC ..... B65H 9/10; B65H 9/103; B65H 9/105; B65H 9/12; B65H 2406/34; B65H 2406/342; B65H 2406/343; B65H 2406/344; B65H 2511/242; B65H 2301/44718; B65H 2301/331; B65H 9/00; B65H 9/002
See application file for complete search history.

(56) References Cited

U.S. PATENT DOCUMENTS 4,060,237 A * 11/1977 Degen ..... B65H 5/24 271/231
4,591,143 A * 5/1986 Jeschke ..... B65H 9/105 271/227
4,648,589 A * 3/1987 Emrich ..... B65H 9/105 271/195
4,693,463 A * 9/1987 Schwebel ..... B65H 9/105 271/236
4,840,697 A * 6/1989 Goodfellow ..... B29D 30/3007 156/378
4,971,304 A 11/1990 Lofthus
5,090,683 A 2/1992 Kamath et al.
5,169,140 A 12/1992 Wenthe, Jr.
5,219,159 A 6/1993 Malachowski et al.
5,278,624 A 1/1994 Kamprath et al.
5,301,892 A 4/1994 Merz et al.
5,419,256 A * 5/1995 Pollich ..... B65H 9/105 101/233
5,697,608 A 12/1997 Castelli et al.
5,794,176 A 8/1998 Milillo
6,137,989 A 10/2000 Quesnel
(Continued)

*Primary Examiner* — Jeremy R Severson
(74) *Attorney, Agent, or Firm* — Fay Sharpe LLP

(57) ABSTRACT

A sheet registration system includes a transport member on which a sheet is conveyed in a process direction, a vacuum shuttle, and a feedback system. The vacuum shuttle includes a vacuum head which applies suction to the sheet and actuators for rotating the vacuum head in a plane parallel to a plane of the transport member and translating the vacuum head in a cross-process direction. In response to feedback instructions generated by the feedback system, the actuators move the vacuum head, relative to the transport member, while the vacuum is applied to the sheet. The sheet registration system is suitable for use in a printer for reducing skew and lateral offset of sheets of print media.

20 Claims, 9 Drawing Sheets

(56) References Cited

U.S. PATENT DOCUMENTS

| | | | | |
|---|---|---|---|---|
| 6,168,153 | B1 | 1/2001 | Richards et al. | |
| 6,446,959 | B2 * | 9/2002 | Butterfass | B65H 9/105 271/226 |
| 6,481,953 | B1 * | 11/2002 | Michel | B65H 3/0825 271/91 |
| 6,488,275 | B2 | 12/2002 | Schlageter | |
| 6,533,268 | B2 | 3/2003 | Williams et al. | |
| 9,757,963 | B2 * | 9/2017 | Shapira | B41J 11/0085 |
| 2002/0140157 | A1 | 10/2002 | Moore et al. | |
| 2003/0146567 | A1 | 8/2003 | Williams et al. | |
| 2006/0208416 | A1 | 9/2006 | Dejong et al. | |
| 2006/0255525 | A1 | 11/2006 | DiNatale et al. | |
| 2008/0240820 | A1 | 10/2008 | deJong et al. | |
| 2010/0061786 | A1 | 3/2010 | Bortel et al. | |
| 2010/0225691 | A1 | 9/2010 | Wright et al. | |
| 2011/0139586 | A1 | 6/2011 | Lin et al. | |

* cited by examiner

VACUUM SHUTTLE WITH STITCH AND ROLL CAPABILITIES

BACKGROUND

The exemplary embodiment relates to registration of sheet media and in particular to a registration system which includes a vacuum shuttle head configured for realignment of the sheets.

Transport systems are widely used for transporting sheet media between and within modules of a printing system, such as between a sheet feeder and a marking module, or on a return path through the marking module to enable duplex (double-sided) printing. The transport system may include a combination of rollers, conveyor belts, vacuum-assisted transport units, and the like. In order to ensure that each sheet arrives at a printer component with no more than an acceptable level of skew and lateral errors, registration subsystems are used to steer the sheets to achieve correct alignment.

There are demands for new printer designs that are able to increase the size of the sheet (e.g., to about 66 cm, or longer, in the process-direction) or to increase the printer speed from what is conventionally achievable. For the registration subsystem, steering long sheets and steering sheets at high speeds are challenging. In high speed printers, the amount of time available to perform the registration correction is reduced, which can increase stresses on the sheets. This means that sheets may not be correctly registered if their input error is too large. Registration correction algorithms are used to attempt to steer these sheets to the machine registration targets. However, the large corrections may result in sheet trailing edges being driven into the sidewalls of the transport (resulting in sheet damage or jams) or cause sheets to slip, breaking free of the drive nips, resulting in poor registration.

In one type of registration subsystem, skew and lateral errors are corrected in one motion. This correction induces more skew to move the sheet laterally, creating a 'tail-wag' motion of the sheet. This motion of the sheet is stressful, and the tangential forces on the sheet may exceed the threshold of slip with larger sheets. Another type of registration subsystem uses independent drive rolls for correcting skew while lateral correction is effected by a translating (cross process) carriage. This has an advantage of decoupling the lateral and skew correction. However, the use of the translating carriage limits the maximum speed of the printer system due to the limit on the carriage return time that can be achieved, given the mass of the carriage (including motors, rollers and other drive elements).

One method used to enable registering large sheets is to manually adjust the positions of preceding modules to try to keep the input error low. For example, the sheet feeder may undergo an alignment procedure to reduce the errors in the sheet entering the marking module, or a duplex path alignment procedure may be performed. However, such module alignment procedures impact only the mean input error and are unable to address sheet-to-sheet variations. Thus, even though the average input error may be within acceptable bounds, sheet-to-sheet variations can result in mis-registration of some of the sheets.

There remains a need for a system and method for media registration which address these deficiencies and enable improvements in the capability of a printing system to handle faster sheet speeds, larger sheet sizes, and/or larger weight sheets.

INCORPORATION BY REFERENCE

The following references, the disclosures of which are incorporated herein in their entireties are mentioned:

U.S. Pat. No. 5,090,683, issued Feb. 25, 1992, entitled ELECTRONIC SHEET ROTATOR WITH DESKEW, USING SINGLE VARIABLE SPEED ROLLER, by Kamath, et al., describes a device for selectively turning documents which includes separately-driven drive rollers that are aligned transverse to a process direction, enabling the documents to be turned. Sensors adjacent the drive rollers are used to measure the skew of the document prior to being rotated.

U.S. Pat. No. 5,301,892, issued Apr. 12, 1994, entitled APPARATUS AND METHOD FOR WINDING A STRIP OF WEB MATERIAL ONTO A SPOOL, by Merz, et al., describes a vacuum shuttle head for holding a cut end of a web.

U.S. Pat. No. 6,488,275, issued Dec. 3, 2002, entitled ACTIVE PRE-REGISTRATION SYSTEM USING LONG SHEET TRANSPORTS, by Schlageter, describes a pre-registration system, which decreases the lateral offset of sheets before they reach an active registration system, by pivoting a long transport with a stepper motor in conjunction with sensing a lateral edge of the sheets.

U.S. Pub. No. 20020140157, published Oct. 3, 2002, entitled VACUUM CORRUGATION SHUTTLE FEED DEVICE FOR HIGH CAPACITY FEEDER, by Moore, et al., describes a paper feeder which acquires individual sheets of paper using positive and negative air pressures from the top of a stack and transports them forward. By using information input by the operator (paper weight and coating configuration) and information from sensors (indicating curl direction and magnitude), blower speeds can be adjusted to achieve the best possible performance for the given paper conditions.

U.S. Pub. No. 20060255525, published Nov. 16, 2006, entitled SHEET FEEDER VACUUM FEED HEAD WITH VARIABLE CORRUGATION, by DiNatale, et al., describes a sheet separating and feeding system with a vacuum feed head for separating a top sheet from a stack of sheets for sheet feeding.

U.S. Pub. No. 20100061786, published Mar. 11, 2010, entitled APPARATUS AND METHOD FOR DETECTING THE TRAVEL DIRECTION OF MEDIA IN A MEDIA PATH IN AN IMAGE MARKING AND FUSING SYSTEM by Van Bortel, et al., describes controlling the rotational angle of a fusing module in response to sensed information on an unfused marked media travel direction.

U.S. Pub. No. 20100225691, published Sep. 9, 2010, entitled SYSTEM AND METHOD FOR CORRECTING STITCH AND ROLL ERROR IN A STAGGERED FULL WIDTH ARRAY PRINTHEAD ASSEMBLY, by Wright, et al., describes a method for evaluating and correcting printhead position in a staggered full width array (SFWA) inkjet printhead assembly. Positional correction data for roll and stitch displacements is obtained printhead actuators are operated when a predetermined threshold in a displacement range is exceeded.

U.S. Pub. No. 20110139586, published Jun. 16, 2011, entitled VACUUM TRANSPORT BELTS, by Liang-Bih Lin, et al., describes media vacuum transport systems including media vacuum transport members.

BRIEF DESCRIPTION

In accordance with one aspect of the exemplary embodiment, a vacuum-assisted sheet registration system includes a transport member on which an associated sheet is conveyed in a process direction. A vacuum shuttle includes a vacuum head, which applies suction to the sheet, and actuators for rotating the vacuum head and for translating the vacuum head in a cross-process direction, relative to the transport member. A feedback system generates feedback instructions. The translation and rotation occurs while the vacuum is applied to the sheet, in response to the feedback instructions, to register the sheet.

In accordance with another aspect of the exemplary embodiment, a printer includes a marking engine. A sheet transport system conveys associated sheets on a paper path in a process direction to the marking engine. A vacuum shuttle, positioned in the paper path upstream of the marking engine, is provided for reducing skew and lateral offset of at least some of the sheets. The vacuum shuttle includes a vacuum head for applying suction to the conveyed sheets, a first actuator for translating the vacuum head in a cross-process direction, during the applying of suction, and a second actuator for rotating the vacuum head, during the applying of suction. A control system controls the first and second actuators.

In accordance with another aspect of the exemplary embodiment, a vacuum-assisted sheet registration method includes conveying a sheet on a paper path in a process direction, providing for detecting skew and lateral offset of the sheet, applying suction to the sheet with a vacuum head, and while the vacuum is applied to the sheet, translating the vacuum head in a cross-process direction to reduce the detected lateral offset, and rotating the vacuum head to reduce the detected skew.

DETAILED DESCRIPTION

Aspects of the exemplary embodiment relate to a sheet registration system incorporating a vacuum feed shuttle (or simply, a vacuum shuttle) which is controllable for lateral translation and angular rotation and to a method for registering sheet media with the registration system. The vacuum shuttle is positioned to acquire a sheet in the registration path and pull the sheet towards a marking device transport.

As used herein, a "printer," or a "printing system" refers to one or more devices used to generate printed media by forming images on print media, using a marking material, such inks or toner particles. The printer may be a digital copier, bookmaking machine, facsimile machine, multifunction machine, or the like, which performs a print outputting function. The print media may be sheets of paper, card, transparencies, parchment, film, fabric, plastic, photofinishing papers, or other coated or non-coated flexible substrates suitable for printing.

The printer includes a print module which may incorporate one or more xerographic marking devices in which toner particles are transferred from an electrically charged surface to the print media and then fused to the sheet. Alternatively, the printer may be inkjet printer which incorporates an inkjet marking device including inkjet heads which jet droplets of ink onto the print media, which are then cured, e.g., with ultraviolet radiation. Other marking devices are also contemplated. The printer may be configured for monochrome (single color) and/or color (more than one color) printing.

The "leading edge" of a sheet of print media refers to an edge of the sheet that is furthest downstream in the process direction. The "process direction" refers to the direction in which a sheet travels along a paper path during the printing process.

While some components of the printer are described herein as modules, this is not intended to imply that they are separately housed from each other and in some embodiments, may be otherwise separated into different housings or contained in a single printer housing.

Figure 1:
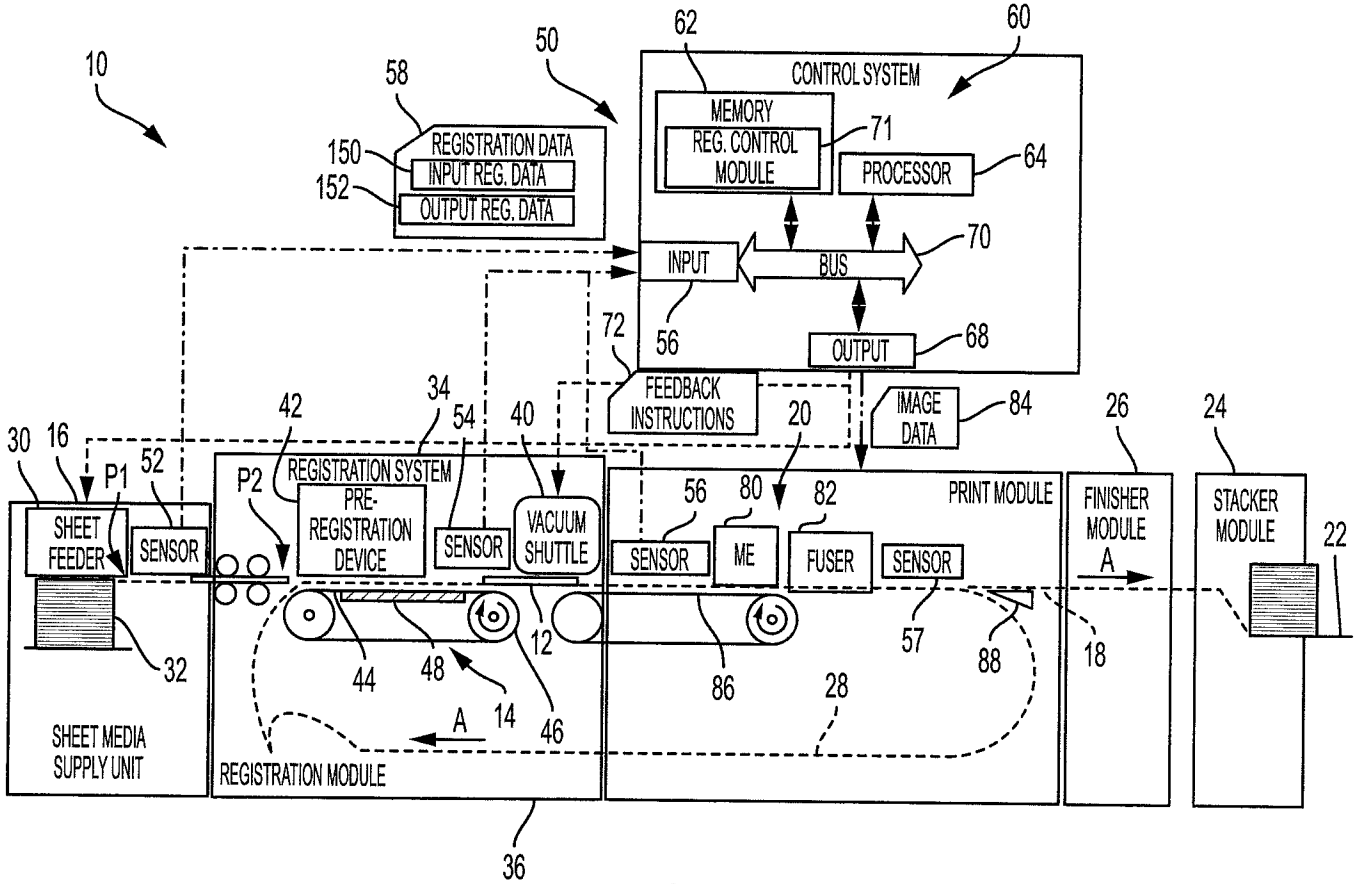
FIG. 1 is a schematic side sectional view of a printing system including a registration system in accordance with one aspect of the exemplary embodiment.

FIG. 1 is a schematic illustration of a printer 10. The printer is configured for forming images on sheets 12 of print media, such as paper, using a marking material, such as inks or toners. The printer 10 may be a xerographic machine, inkjet printer, combination thereof, or the like. A sheet transport system 14 conveys sheets to be printed from a sheet media supply unit 16 along a paper path 18 to a print module 20 in the downstream (process) direction, illustrated by arrow A. From the print module, the sheet transport system 14 conveys the printed sheets to a printed sheet output 22, such as an output tray of a sheet stacker module 24, optionally via one or more additional printer components, such as the illustrated finisher module 26, which performs post-processing operations, such as stapling, collating, binding, and the like. The paper path 18 may include one or more return loop(s), such as the illustrated return loop 28, for returning sheet media from a downstream printer component to an upstream one, e.g., for duplex printing.

The transport system 14 may include various mechanisms for conveying the sheets, such as rollers, drive nips, belts, air/vacuum assisted transport mechanisms, and the like. In particular, a sheet feeder 30 draws sheets singly from a stack 32 in the supply unit 16 and sends them in single file along the paper path 18. A registration system 34, located in a registration module 36, intermediate the sheet feeder 30 and the print module 20, repositions each sheet, as needed, to reduce skew (angular rotation with respect to the process direction) and/or lateral offset (in the cross-process direction).

While the components 16, 20, 24, 26, 30, 34 of the printer are often described as modules, this is not intended to imply that they are separately housed from each other and in some embodiments, may be contained in a single printer housing.

The illustrated registration system 34 includes a vacuum shuttle 40, positioned above the paper path 18, which has stitch/roll capabilities. Specifically, the vacuum shuttle 40 is configured for addressing both skew and lateral offset of each sheet 12 traveling along the paper path 18. The registration system 34 may further include one or more additional sheet registration devices for reducing skew and/or lateral offset, such as the illustrated pre-registration unit 42, which is positioned upstream of the vacuum shuttle 40, and/or a further registration device(s), downstream of the vacuum shuttle 40 (not shown). The sheet 12 may be supported on and/or translated by one or more transport member, such as roller, nips, belts, etc., as it passes through the registration module 36. In the illustrated embodiment, the sheet is transported in the process direction A by a registration transport member 44, such as a belt which is driven by one or more drive members 46, such as rollers. The top part of the belt 44 may be supported, from below, by a planar backing member 48. Other suitable transport members 44 include nip rollers.

Optionally, the printer 10 includes a feedback system 50 which detects at least one of skew and lateral offset of the sheets and provides feedback to components of the printer for assisting in correction of the detected registration errors. The feedback system can also be used for learning repetitive registration errors, allowing the registration system to anticipate the likely corrections which will be needed. The illustrated feedback system 50 includes one or more sensors 52, 54, 56, 57, positioned along the paper path 18, to collect registration (e.g., sensor) data 58 for the conveyed sheets, such as sheet position and/or motion data related to skew and/or lateral offset. Suitable sensors include charge-coupled devices (CCD), contact image sensors (CIS), and similar sensor arrays. The sensors 52, 54, 56, 57 may detect motion and/or position of some or all of the conveyed sheets, or acquire other information from which lateral offset and skew of the respective sheet can be determined.

The registration data 58, acquired by the sensors, is fed to a control system 60, such as a computing device or microprocessor. The control system 60 includes hardware, such as memory 62 a processor 64, and one or more inputs/outputs 66, 68, which may all be connected by a data/control bus 70. The memory 62 stores instructions, such as the illustrated registration control module 71, for receiving information 58 from the sensors and for determining adjustments to the registration system 34 (and optionally other components of the printer) to address (reduce or eliminate) registration errors, such as skew and/or lateral offset. The processor 64 executes the instructions and outputs control signals 72 to the registration module 36, or components thereof, and/or to other components of the printer, such as the sheet feeder 30, for making appropriate adjustments.

The print module 20 can be configured for simplex (single sided) and/or duplex (double-sided) printing. In the illustrated embodiment, the print module 20 is a xerographic (laser) printing module and includes one or more marking devices 80 and one or more fixing devices, such as fuser 82. In the marking module, marking media in the form of toner particles is attracted from a photoconductor surface to the charged sheet 12 to form an image, which is fused to the sheet by the fuser 82 using heat and/or pressure. Image data 84 for forming the image to be printed, is received, by the print module 20, from the control system 50, or a separate control system. The sheets are conveyed from the registration module 36 to the marking engine 80 by a marking transport 86, such as a conveyor belt. A diverter 88, downstream of the marking engine 80, may be used to divert the sheets into the return loop 28, when needed, for duplex printing.

In other embodiments, the print module may be an inkjet print module which includes a printhead as the marking device 80, the printhead including an array of inkjet nozzles that apply droplets of ink to the sheet in a predefined pattern to form the image. The images may be cured with heat and/or UV radiation applied by an appropriate fixing device 82.

Independent of the type of print module(s) 20 employed, registration errors, such as skew and/or lateral offset in the sheet 12 as it enters the print module can result in incorrect positioning of the image on the sheet. The exemplary registration system 34 with vacuum shuttle 40 assists in reducing registration errors in a manner which places less stress on the sheets than a conventional registration system, can accommodate print media of larger sizes and/or weights, and is able to compensate for errors in each sheet individually.

Figure 2:
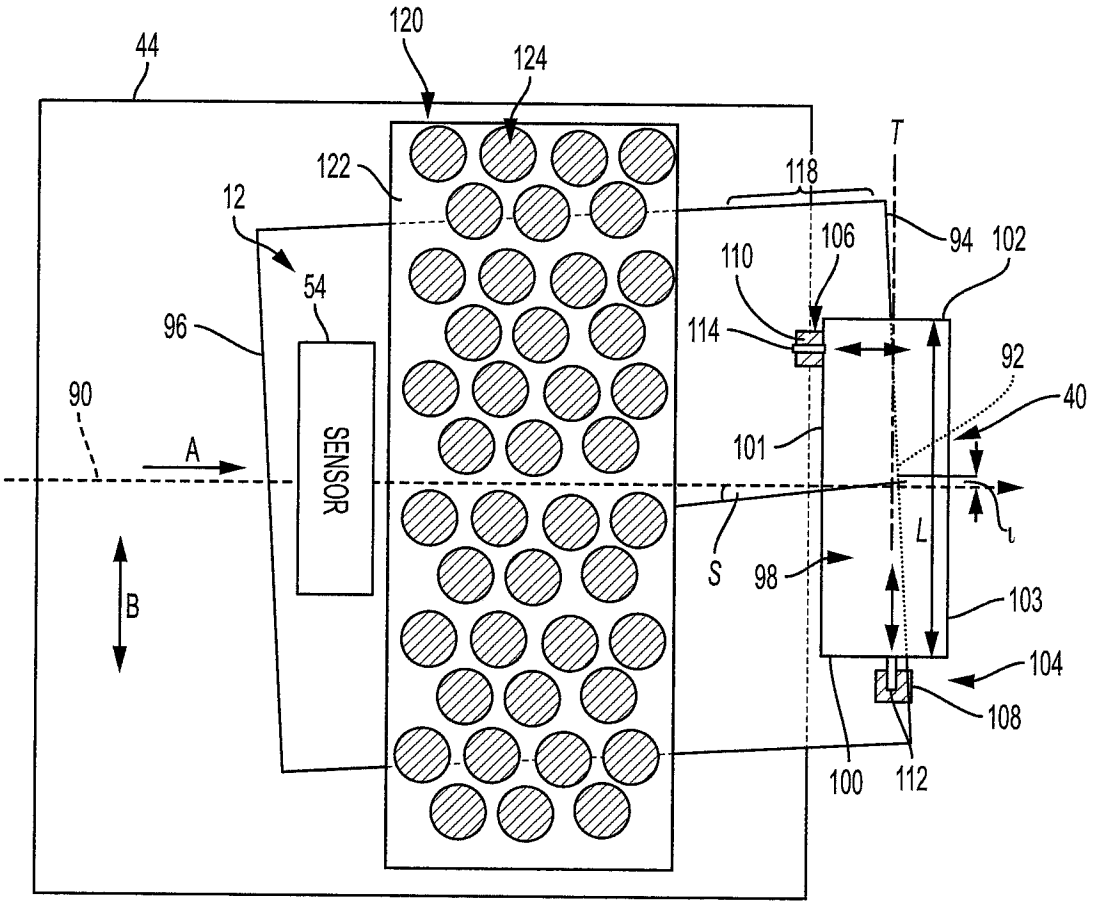
FIG. 2 is a top plan view of the vacuum shuttle of FIG. 1 in a first position.
Figure 3:
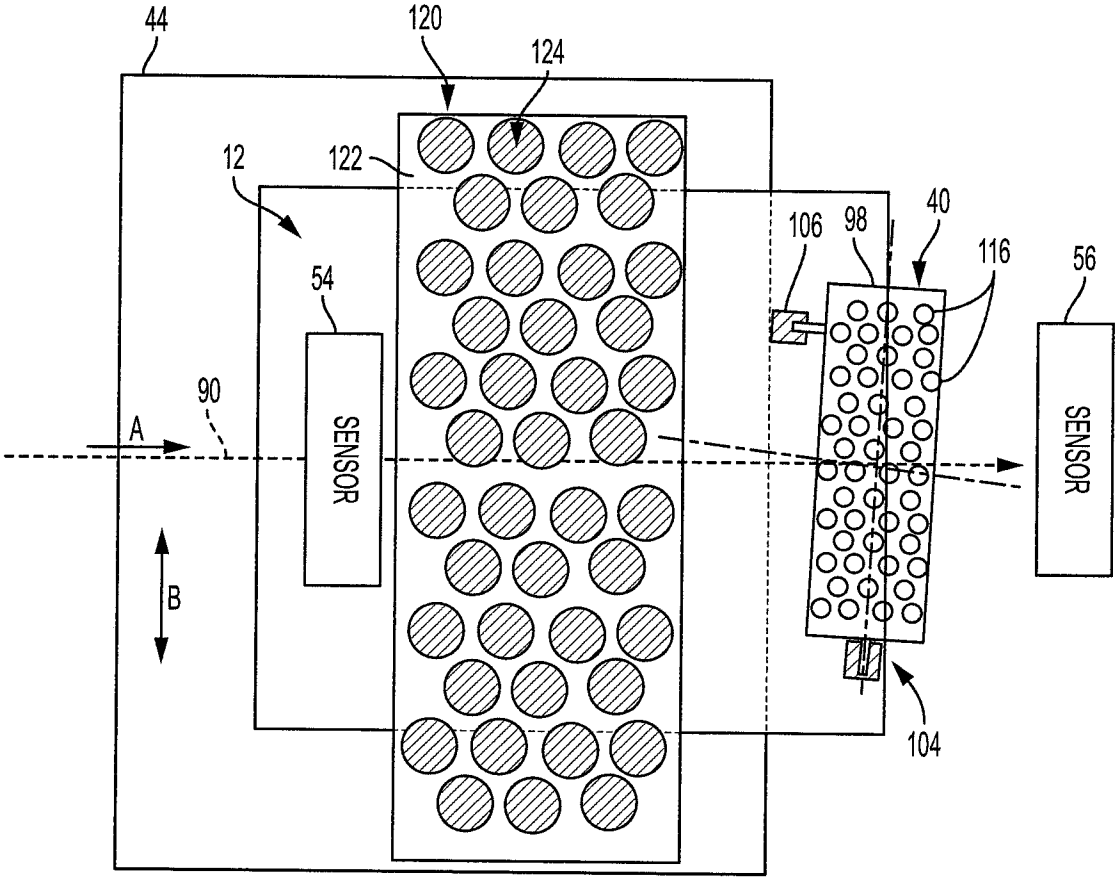
FIG. 3 is a top plan view of the vacuum shuttle of FIG. 1 in a second position.

FIGS. 2 and 3 schematically illustrate the operation of the vacuum shuttle 40 in registering of a sheet 12 as view from above. The axis of the desired registration of the sheet, in the process direction, is indicated by dashed line 90, which may lie along the midpoint of the belt 44 or other suitable location. Skew s is the degree to which the sheet is angled from the line 90 and is typically measured in a measure or rotation, such as milliradians (mrad). Lateral offset l may be defined as the lateral distance, from the registration axis 90, of the midpoint 92 of the leading edge 94 (or trailing edge 96, or somewhere between the two) of the sheet 12 and may be measured in mm. Lateral offset can be particularly problematic for large sheets since, when combined with skew, can lead to large variations from one end of the sheet to the other. Accordingly, lateral tolerances are generally tighter for larger sheets. For example, for standard sheets (less than 20.5" (52.07 cm) in length) in a conventional high-speed printer, the lateral specification for l may be ±11 mm, which may be decreased to ±4 mm for large sheets (20.5" (52.07 cm) –22.5" (57.15 cm) in length and ±2 mm for extra-large sheets above 22.5" and ±1 mm for the largest sheets that can be processed (e.g., 35" (about 90 cm)). Skew tolerance may be independent of the size of the sheet, such as ±20 mrad for s. With the present registration system, these tolerances may be increased When the leading edge 94, or other part of the sheet reaches a known target point (detected by a point sensor), the sheet lateral position and skew can be calculated. These values can then be used by the control system 60 to determine appropriate skew and lateral corrections to steer the sheet to its target, which in the embodiment illustrated in FIG. 1, is the marking engine 80.

The illustrated vacuum feed shuttle 40 includes a vacuum head 98 which applies suction to the sheet 12 as the sheet moves in the process direction A. The vacuum head 98 is movable laterally, in the cross-process direction B, and rotatable, in a plane parallel to that of the sheet 12, in order to implement the lateral and skew corrections determined by the control system 60. The vacuum feed shuttle 40 thus serves to hold the forward end of the sheet, then translate and/or rotate it, before delivering the sheet to the marker transport.

As illustrated in FIG. 2, the vacuum head 98 has first, second, third, and fourth sides 100, 101, 102, 103, which together define an upwardly-extending side wall of the vacuum head. The fourth side 103 defines a leading edge of the vacuum head. The first and third sides 100, 102 of the head 98 are the sides most closely aligned with the process direction and the second and fourth sides 101, 103 of the head 98 are the sides most closely aligned with the cross-process direction and are perpendicular (or substantially perpendicular) to the first and third sides 100, 102. By "substantially perpendicular," it is meant no more than 90°±10° or 90°±5°. The head 98 may have a length L, along the transverse axis T of the head, i.e., between sides 100, 102, of at least one third or at least a half of the maximum width (in the cross process direction) of the sheets to be processed by the printer, and/or no greater than a minimum width of the sheets to be processed, e.g., L is at least 10 cm or at least 15 cm and may be up to 20 cm. The length L may be greater than the width, in the process direction, of the head 98.

The vacuum shuttle 40 includes a first (stitch) actuator 104, which is positioned adjacent the first side 100 (and/or third side 102) of the vacuum head 98 to implement lateral movement of the vacuum head. In particular, the actuator 104 is generally aligned with the transverse axis T of the vacuum head 98. A second (roll) actuator 106 is positioned adjacent the second side 101 of the vacuum head 98, to implement rotational movement of the head 98, in a plane parallel to the sheet 12 and belt 44. The actuator 106 is offset from the center of the second side 101, i.e., closer to the third side 102 of the head than to the first side 100.

As illustrated in FIGS. 2 and 3, each of the actuators 104, 106 may include a respective drive mechanism 108, 110, such as a micro-stepper motor, servomotor, a solenoid, or other linear actuator. The drive mechanism 108, 110 drives an extensible member 112, 114 in a direction perpendicular or substantially perpendicular to the respective adjacent wall 100, 101 of the vacuum head 98.

In one embodiment, the drive mechanisms 108, 110 each remain in a fixed position, with respect to the process and cross-process directions, although rotational movement may be permitted. The vacuum head 98 may be mounted on the extensible members, and/or otherwise supported for angular and lateral movement in a plane parallel to the sheet. In another embodiment, not illustrated, the drive mechanisms 108, 110 are attached to the respective side 100, 101 of the vacuum head and drive the extensible member 112, 114 in an opposite direction, away from the respective wall, against a respective bearing surface mounted in a fixed position adjacent to the actuator. The extensible member 112, 114 may be a post or screw, which is extended away from, or towards, the actuator motor, to push/pull the vacuum head 98 away from/towards the respective actuator. Depending on the amount of lateral or skew correction needed, the actuators 104, 106 may be driven at faster or slower speeds in order to complete the correction in the time available. In some embodiments, the transport 46 may be halted or slowed, temporarily, to increase the time available for correction. In general, correction can be achieved in about 100-200 ms.

The vacuum shuttle 40 can be adjusted with the stitch actuator 104 to compensate for lateral offset and any skew from the paper guides can be reduced with the roll actuator 106, delivering a better pre-registered sheet to the downstream component(s) ahead of it. As shown in FIG. 3, which illustrates the sheet 12 after registration correction, the actuators 104, 106 on the vacuum shuttle have been operated to "stitch and roll" the vacuum head 98 to reduce the skew and fix the lateral position of the sheet before marking. As a result, angle s (the skew of the sheet) is reduced to closer to 0 mradians and the lateral offset l of the sheet is reduced to closer to 0 mm, as the vacuum head translates and rotates.

The vacuum head 98 applies suction to the sheet 12 during the translation and rotation of the vacuum head, e.g., through a two-dimensional array of suction ports 116, as shown schematically in FIG. 3. The vacuum head 98 is controlled such that it applies suction only to a forward end 118 of the sheet (less than half of the sheet). As a result, the leading edge 94 of the sheet moves substantially in tandem with the movement of the shuttle 98. The trailing edge 96 of the sheet, which is not tightly held by nips, responds to the movement of the leading edge and is thus also registered. When the stitch and roll motion is complete, the vacuum is released and the forward end 118 of the sheet drops onto a transport member below, such as the marker transport 86.

Figure 4:
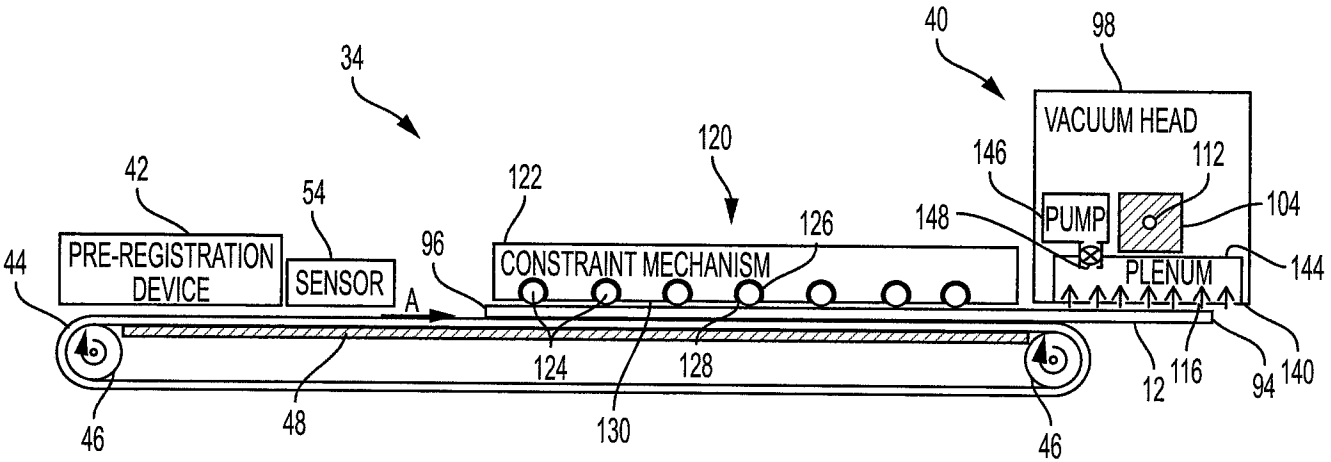
FIG. 4 is an enlarged schematic side sectional view of the registration system of FIG. 1.

Optionally, a constraint mechanism 120 serves to reduce upward shift of the portion of the sheet adjacent to the trailing edge 96 by providing a downward force on the sheet 12 and/or limiting its upward movement, without unduly limiting the ability of the trailing edge to move in the plane of the transport 44. With reference also to FIG. 4, the exemplary constraint mechanism 120 includes a generally planar structure 122, such as baffle plate or movable belt, positioned above the transport 44, to hold the sheet between the structure 122 and the transport. The illustrated structure 122 supports an array of rotatable idler members 124, such as balls, rollers, omnidirectional wheels, or the like. The rotatable members 124 do not significantly restrict freedom of movement of the sheet 12 in the plane of the sheet, but urge the sheet into contact with the transport member 44 below the sheet. The illustrated rotatable members 124 are spherical balls, which are spaced from each other in the process and cross process directions. The balls are each held within a respective bearing cavity 126 with an opening 128 in a lower surface 130 of the plate 122. The cavity is slightly larger than the diameter of the ball, while the opening 128 is slightly smaller than the diameter of the ball, thus retaining the ball within the cavity, while allowing the ball to protrude through the opening 128 and contact the sheet. The balls 124 may be formed of rubber, metal, e.g., steel, or plastic. As the sheet 12 moves, the balls rotate. The balls are not driven and are independently free to move in any direction, allowing the sheet to undergo registration corrections as it passes under the constraint mechanism 120.

Other constraint mechanisms 120 positioned above the sheet are also contemplated, such as a simple baffle, an air-assisted baffle through which air is pumped through perforations onto the sheet, a vibrating baffle, or the like, or a combination of constraint mechanisms.

The vacuum head 98 includes a horizontal plate 140 forming a base of the vacuum head. The array of suction ports 116 may be defined by openings in the plate 140. For example, the openings may be distributed over the plate in rows and columns, as illustrated schematically in FIG. 3. There may be at least five rows of suction ports 116 in the cross process direction and at least three columns of suction ports in the process direction, or at least 15, or at least 20, or at least 30 suction ports in total. The suction ports 116 are in fluid communication with a plenum 144, which in turn is connected to a suction source 146, such as a vacuum pump. The suction source 146 may be located in the head 98, as illustrated in FIG. 4, or located elsewhere in the printing system and fluidly connected with the plenum by suitable tubing. In other embodiments, the suction ports may be connected to separate vacuum tubes. The vacuum pump 146 may be controlled to apply suction to the sheet 12 prior to and during the lateral and/or rotational movement of the vacuum head 98, e.g., by opening and closing a valve 148 in a conduit connecting the pump to the plenum 144. The leading edge of the sheet is held by the suction from the suction heads and is registered as the vacuum shuttle moves laterally and/or rotates. The trailing edge 96 is drawn into the desired alignment by the movement of the leading edge 94. The vacuum shuttle is not limited to the design shown in FIG. 4, other types of vacuum head 98 are also contemplated.

In addition to providing lateral and rotational movement of the leading edge of the sheet, the vacuum shuttle 40 may be used to convey the sheet in a downstream direction. For example, the vacuum shuttle 40 may apply pressurized air to the sheet (e.g., through ports 116 or separate ports) after the vacuum is released, in a direction to urge the sheet in the process direction.

As will be appreciated, a vacuum shuttle configured as for vacuum shuttle 40 can be used elsewhere in the printing system. A vacuum shuttle intermediate the sheet feeder 30 and the preregistration device 42, e.g., at position P1 and or P2, may be used to provide a more accurate input to the preregistration device 42, compensating for variance in the feeder drawer latch system and operator error induced by poor paper loading.

The preregistration device 42, where used, may be any suitable device for assisting in registration of the sheets 12. As an example, the preregistration device 42 may be a Translation Electronic Registration (TELER) type of registration device or an agile nip registration device. A TELER system often includes three optical sensors, a pair of coaxial independently driven drive rolls, a carriage with a linear drive on which paper drive rolls are mounted, and a microprocessor controller. The carriage moves the rollers in the transverse direction and then is returned to its original position for the next sheet. In an agile system, a pair of independently driven selectively actuable nips are used to drive a sheet transverse to a paper path direction until the edge of a sheet is registered laterally and without skew. The transverse nips are then deactivated and a drive nip moves the sheet in a process direction along the paper path. U.S. Pub. Nos. 20030146567, 20060208416, and 20080240820, and U.S. Pat. Nos. 4,971,304, 5,169,140, 5,219,159, 5,278,624, 5,697,608, 5,794,176, 6,137,989, 6,168,153 and 6,533,268, incorporated by reference, provide descriptions of such registration systems, which may be used herein as a preregistration device 42. Alternatively or additionally, a registration device (not shown) as described for pre-registration device 42 may be positioned downstream of the vacuum shuttle, to provide a fine-tuned registration of the at least partially registered sheet 12, after it leaves the vacuum shuttle 40 and before it enters the downstream printer component, such as the marking engine 80.

The control system 60 controls the first and second actuators 104, 106 in order to reduce skew and/or lateral offset of the sheet. In particular, the information from the position sensor 54 may be used to control the first and second actuators 104, 106 to provide the appropriate movement of the vacuum head 98, during suction, and may also be used to adjust the amount of suction applied by the vacuum head and/or the length of time over which the suction is applied to the sheet. The sensor 54 may acquire the sensor data 58 before the sheet has reached the vacuum shuttle. Additionally or alternatively, the sensor data may be acquired later. For example the sensor 54 may acquire the sensor data 58 when the vacuum shuttle has applied suction to the forward end 118 of the sheet.

Additional sensor(s) 56 (FIG. 1), positioned to acquire sheet position data downstream of the vacuum head 98, may be used to assess whether the registration correction was effective, and to fine tune the control of the actuators 104, 106 for registering subsequent sheets. Alternatively or additionally, the sensors 56 may be used to adjust downstream printer components, such as the marking device 80 and/or fixing device 82 to enable them to cope with any remaining mis-registered sheet. In the case of duplex printing, a sensor 57, positioned downstream of the marking engine 80 may be used to ensure that the image on the second side of the sheet is closely aligned with that on the first side of the sheet. In this case, registration errors detected for the first side of the sheet may be retained for the second side and/or used to reposition the image on the second side.

In one embodiment, a feedback loop is used to learn the correction needed and position the vacuum shuttle 40 appropriately to receive the next sheet. In this embodiment, the sensor array 54 may be used to measure the position of the sheet when it is acquired by the vacuum shuttle 40. A feedback loop then begins to adjust the shuttle head for the subsequent sheet. This approach may be useful to compensate for gradual shifts in the stack 32, however, in order to be able to address outliers, the vacuum shuttle 40 is adjusted independently for each sheet. The various registration devices 40, 42, etc. in the printing system can all be controlled by the same control system 60, allowing them to operate in concert to reduce registration errors. Feedback instructions 72 may be provided to each of the registration devices, based on the received sensor information 58. In the case of the vacuum shuttle, the feedback instructions may include some or all of start and stop times for the vacuum pump 146/suction to commence and stop; lateral displacement of the feed head during suction (and/or other instructions for actuator 104, such as speed of the actuator motor 108); angle of rotation of the vacuum feed shuttle during suction (and/or other instructions for actuator 106, such as speed of the respective actuator motor 110). In some embodiments, the feedback instructions may include instructions suitable for returning the vacuum shuttle head 98 into a suitable position for receiving the next sheet.

Figure 5:
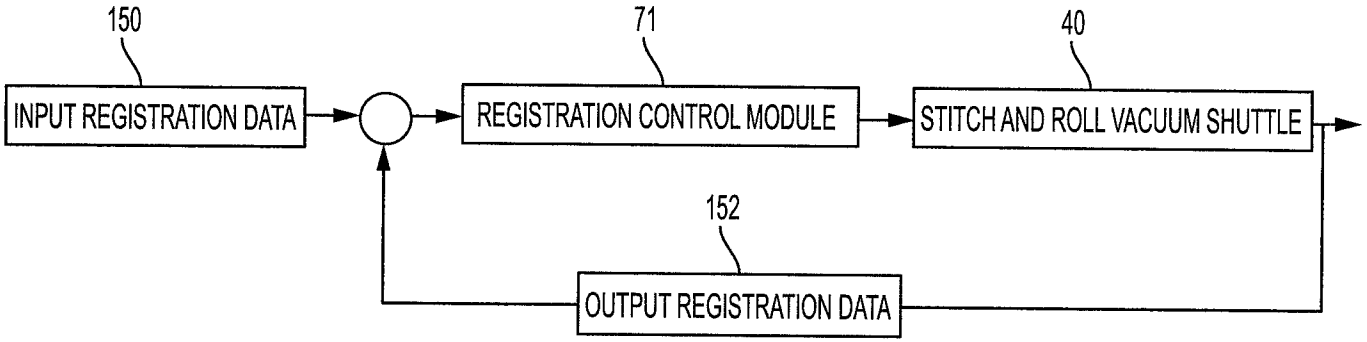
FIG. 5 is a control diagram for a vacuum shuttle in accordance with one embodiment.
Figure 6:
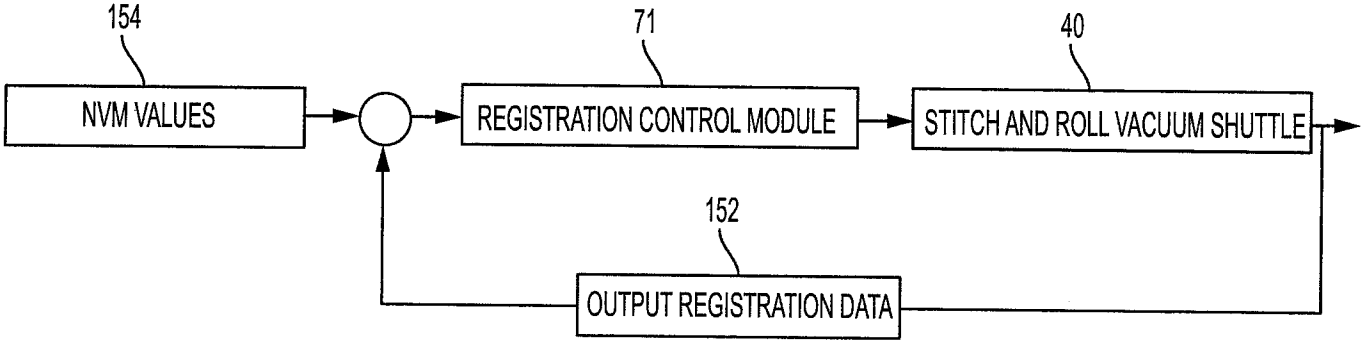
FIG. 6 is a control diagram for a vacuum shuttle in accordance with another embodiment.

FIGS. 5 and 6 illustrate example control diagrams. FIG. 5 shows a control diagram for the case of a vacuum shuttle 40 forming a part of the registration system 34. Input registration data 150 may be collected using a pair of CCD sensors 54 or similar sensing device, to read the skew and lateral offset of the forward edge 94 of the sheet (FIG. 3). Output registration data 152 may be collected in a similar fashion, e.g., by sensor 56 (FIG. 4), or it may be collected downstream of marking, where the sheet could be scanned, e.g., by sensor 57, and corrections to image-on-paper (IOP) registration could be made on-the-fly.

FIG. 6 shows a control diagram for the case of a vacuum shuttle (analogous to vacuum shuttle 40) which forms a part of the sheet feeder 30, e.g., at position P1. In this embodiment, nonvolatile memory (NVM) values may be stored values from previous runs, or zeroes (no correction) for the first run of a given media and tray. Output registration data 152 may be acquired by sensor 52 or the input registration data acquired by sensor 54.

Figure 7:
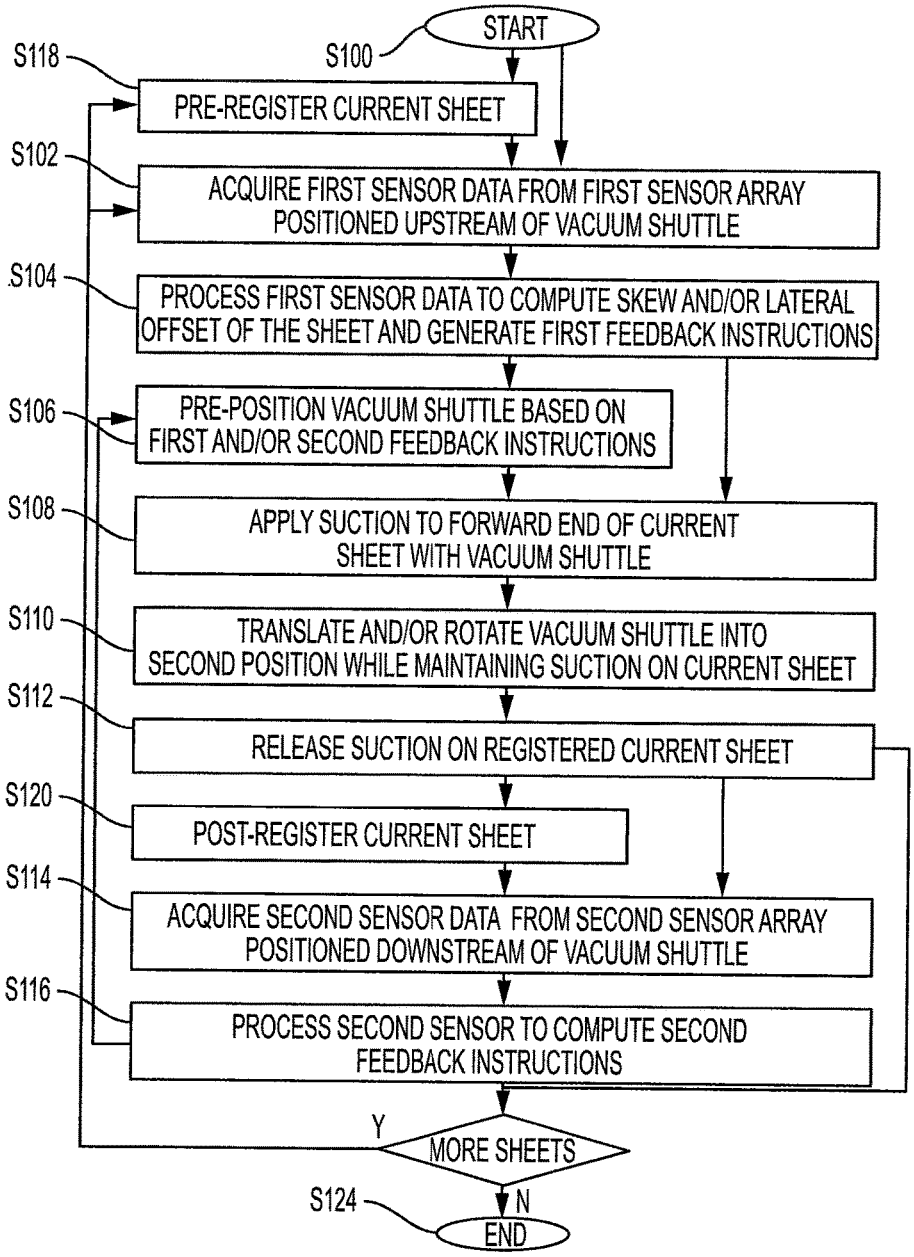
FIG. 7 illustrates a method of printing.

With reference to FIG. 7, a sheet registration method which may be performed with the registration system of FIGS. 1-4 is shown. The method begins at S100.

At S102, first sensor data 58 is acquired from a first sensor array 54 positioned upstream of a vacuum shuttle 40 of a registration system to acquire sheet position and or motion information, e.g., as a leading edge 96 of a current sheet 12 is conveyed beneath the sensor array 54.

At S104, the first sensor data is processed by the control system 60 to compute first feedback instructions 72 for the vacuum shuttle 40 which, when implemented, are predicted to reduce registration errors in the sheet to within acceptable tolerance limits on the errors.

At S106, in response to the first feedback instructions 72 (and/or second feedback instructions, described below), the vacuum shuttle 40 may be moved into a first position, by operating actuator 104 and/or 106, if the vacuum shuttle is not already in a suitable position for receiving the sheet.

At S108, a vacuum is applied to the suction ports 116 of the vacuum head 98, when the leading edge of the sheet has reached the vacuum shuttle, to apply suction to hold the forward end 118 of the sheet in a fixed position, relative to the vacuum head 98.

At S110, the vacuum shuttle is moved from the first position (FIG. 2) into a second position (FIG. 3), by operating actuator 104 and/or 106 in accordance with the feedback instructions 72, while maintaining the suction on the current sheet. The forward end 118 of the sheet is held by the suction, allowing the sheet to be registered. As will be appreciated, only one of, or neither of, the actuators may be needed for sheets which are within the predefined tolerances.

At S112, the registered sheet 12 is released by lowering the applied vacuum, and the sheet is conveyed downstream by a suitably positioned sheet transport 44 and/or 86, and conveyed to a processing component, such as the marking engine.

Optionally, at S114, second sensor data 58 may be acquired from a second and/or third sensor array 56, 57 positioned downstream of the vacuum shuttle 40 to acquire sheet position and or motion information, e.g., as a leading edge 96 of the same sheet is conveyed beneath the sensor array 56, 57.

At S116, the second sensor data acquired at S114 may be processed by the control system 60 to compute feedback instructions 72 for the vacuum shuttle 40 which, when implemented, are predicted to assist in reducing registration errors in a subsequent sheet(s). The second feedback instructions may be provided to the vacuum shuttle 40 to assist in registering the subsequent sheet when the method returns to S106.

In some embodiments, preregistration of the current sheet is performed at S118 and/or post registration of the current sheet is performed at S120.

If at S122, there are no more sheets to be registered, the methods proceeds to S124, otherwise returns to S102 or S118, where the subsequent sheet serves as the current sheet.

The method ends at S124.

Advantages of the exemplary vacuum feed shuttle 40 may include the following:

1. Nips do not need to be opened and closed to perform separate corrections. Vacuum suction reduces the time necessary to perform steering. Also, this allows for a simpler method of closed loop correction, since small corrections to skew and lateral position of the sheet can occur on-the-fly without having to cycle nips through opened and closed positions and losing time to do corrections from those wait periods.

2. Corrections to lateral offset and skew can occur simultaneously, thus reducing the registration time significantly. This is advantageous for faster throughput.

3. Forces on the registration transport are reduced, with sheets being less out of specification.

4. Avoids/reduces the need for manual adjustment of printer components 80, 82, etc., to compensate for lateral offset and/or skew.

Figure 8:
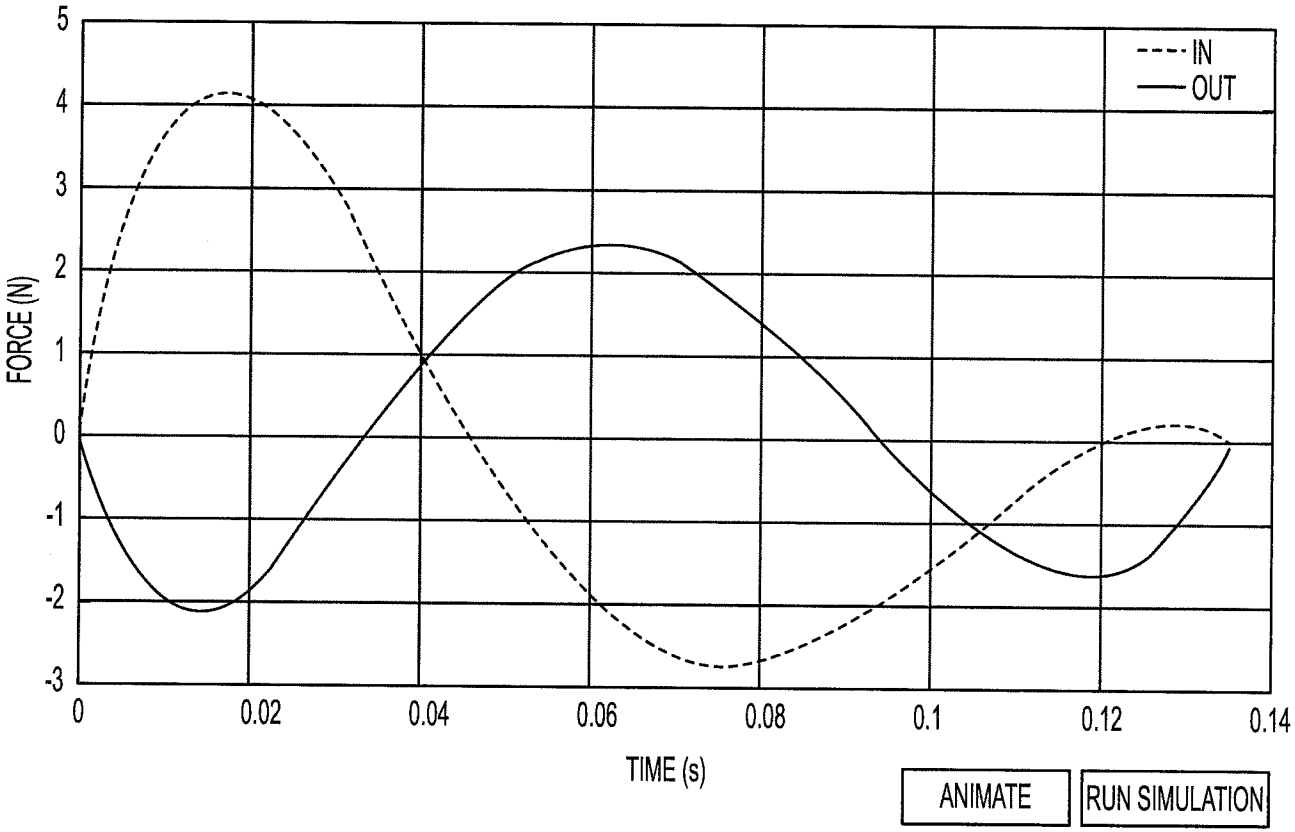
FIG. 8 is a plot illustrating a registration simulation showing tangential force on a paper sheet in the case of relatively high skew and lateral offset.
Figure 9:
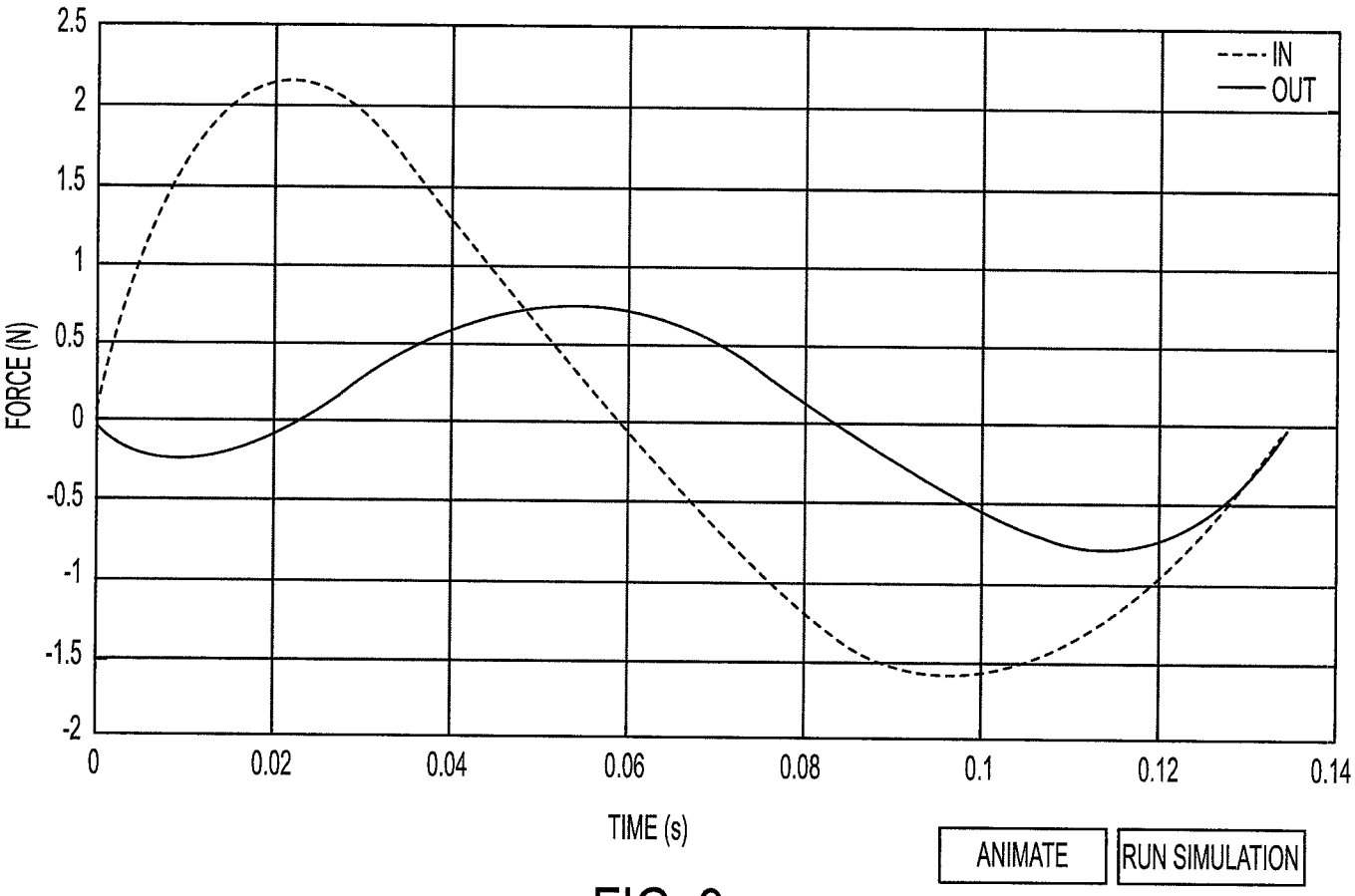
FIG. 9 is a plot illustrating a registration simulation showing tangential force on a paper sheet in the case of relatively low skew and lateral offset.

The registration system 34 is able to correct or significantly reduce registration errors to within predefined tolerances on skew and lateral offset, such as the specifications noted above or narrower, not only in terms of the average sheet, but for individual sheets also. FIGS. 8 and 9 illustrate registration simulations showing tangential force on the paper sheet in the cases of relatively high skew and lateral offset (Example 1 in Table 1) and relatively low skew and lateral offset (Example 2 in Table 1):

TABLE 1

Registration of sheet with high skew and lateral offset

| Paper Properties | | Learned offsets | | Input error data | Ex. 1 | Ex. 2 |
|---|---|---|---|---|---|---|
| Process length (inches) | 26 | Lateral offset (mm) | 0 | Leading edge lateral shift (mm) | 2 | 0.5 |
| X-process width (inches | 14.33 | Skew offset (mrad) | 0 | Trailing edge lateral shift (mm) | −20 | −5 |
| Sheet weight (gsm) | 350 | Process dir. offset (mm) | 0 | Process time (ms) | 135 | 135 |

As can be seen from FIGS. 8 and 9, the tangential force on the input is corrected with the stitch and roll of the vacuum head.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A vacuum-assisted sheet registration system comprising:

a transport member on which an associated sheet is conveyed in a process direction;

a vacuum shuttle comprising:

a vacuum head which applies suction to the sheet, and actuators for rotating the vacuum head and for translating the vacuum head in a cross-process direction, relative to the transport member, while the vacuum is applied to the sheet, in response to feedback instructions, to register the sheet; and a feedback system which generates the feedback instructions.

2. The sheet registration system of claim 1, wherein the vacuum head includes an array of suction ports that are connected to a vacuum source.

3. The sheet registration system of claim 1, wherein the actuators include a first actuator for translating the vacuum head in the cross-process direction and a second actuator for rotating the vacuum head.

4. The sheet registration system of claim 3, wherein the second actuator is operable independently of the first actuator.

5. The sheet registration system of claim 3, wherein the first actuator is positioned adjacent a first side of the vacuum head and the second actuator is positioned adjacent a second side of the vacuum head, the second side being perpendicular or substantially perpendicular to the first side.

6. The sheet registration system of claim 1, wherein the vacuum head includes an array of suction ports that are connected to a vacuum source.

7. The sheet registration system of claim 1, wherein the vacuum head is controlled to apply suction to only a forward end of the sheet.

8. The sheet registration system of claim 1, wherein the feedback system includes:

at least one of:

a first sensor, upstream of the vacuum shuttle, which acquires first sensor information for the sheet, and a second sensor, downstream of the vacuum shuttle, which acquires second sensor information for sheets after registration; and a control system which generates the feedback instructions based on at least one of the first sensor information and the second sensor information.

9. The sheet registration system of claim 8, wherein the feedback system includes the first sensor and wherein the first sensor information comprises position information for the sheet.

10. The sheet registration system of claim 1, further comprising a constraint mechanism for applying a downward force on the sheet while the sheet is being registered.

11. The sheet registration system of claim 10, wherein the constraint mechanism includes an array of rotatable members.

12. The sheet registration system of claim 11, wherein the rotatable members comprise balls which extend from cavities of a support structure.

13. The sheet registration system of claim 1, further comprising at least one of:

a pre-registration device, upstream of the vacuum shuttle, for at least partially registering the sheet; and a post-registration device, downstream of the vacuum shuttle, for at least partially registering the sheet.

14. A printer comprising the sheet registration system of claim 1 and a marking engine, downstream of the sheet registration system, which receives sheets registered by the registration system.

15. A printer comprising:

a marking engine;

a sheet transport system which conveys associated sheets on a paper path in a process direction to the marking engine;

a vacuum shuttle positioned in the paper path upstream of the marking engine for reducing skew and lateral offset of at least some of the sheets, the vacuum shuttle comprising:

a vacuum head for applying suction to the conveyed sheets, and a first actuator for translating the vacuum head in a cross-process direction, during the applying of suction, and a second actuator for rotating the vacuum head, during the applying of suction; and a control system which controls the first and second actuators.

16. The printer of claim 15, further comprising:

at least one of:

a first sensor, upstream of the vacuum shuttle, which acquires first sensor information for sheets prior to registration by the vacuum shuttle, and a second sensor, downstream of the vacuum shuttle, which acquires second sensor information for sheets after registration; and wherein the control system controls the first and second actuators in response to at least one of the first sensor information and the second sensor information.

17. The printer of claim 15, further comprising:

at least one of:

a pre-registration device, upstream of the vacuum shuttle, controlled by the control system; and a pre-registration device, upstream of the vacuum shuttle, controlled by the control system.

18. A vacuum-assisted sheet registration method comprising:

conveying a sheet on a paper path in a process direction;

providing for detecting skew and lateral offset of the sheet;

applying suction to the sheet with a vacuum head;

while the vacuum is applied to the sheet, translating the vacuum head in a cross-process direction, to reduce the detected lateral offset, and rotating the vacuum head to reduce the detected skew.

19. The sheet registration method of claim 18, wherein the providing for detecting skew and lateral offset of the sheet includes receiving sensor data from at least one sensor positioned in the paper path and computing at least one of skew and lateral offset of the sheet based on the received sensor data.

20. The sheet registration method of claim 18, further comprising at least one of:

at least partially registering the sheet with a pre-registration device, located upstream of the vacuum head; and at least partially registering the sheet with a post-registration device, located downstream of the vacuum head.

* * * * *